United States Patent [19]

Fleishman

[11] 4,308,698

[45] Jan. 5, 1982

[54] INTERCONNECTING MEMBERS FOR ENCLOSURES

[76] Inventor: Gregg R. Fleishman, 6071 Hargis St., Los Angeles, Calif. 90034

[21] Appl. No.: 128,504

[22] Filed: Mar. 10, 1980

[51] Int. Cl.[3] ..... E04B 1/32; E04H 12/06; E04H 12/10

[52] U.S. Cl. ..... 52/81; 52/590; 52/648; 404/41

[58] Field of Search ..... 52/81, 80, 590, 648; 404/41; 46/29, 30; 403/171, 172, 176

[56] References Cited

U.S. PATENT DOCUMENTS

| | | | |
|---|---|---|---|
| Re. 16,867 | 2/1928 | Healy | 404/41 X |
| 1,718,230 | 6/1929 | Graves | 46/29 |
| 1,778,927 | 10/1930 | Wright | 404/41 |
| 2,814,159 | 11/1957 | Green | 46/30 X |
| 2,902,821 | 9/1959 | Kelly, Jr. | 46/30 X |
| 3,667,153 | 6/1972 | Christiansen | 46/30 |
| 3,691,704 | 9/1972 | Novak | 52/81 X |

FOREIGN PATENT DOCUMENTS

| | | | |
|---|---|---|---|
| 691460 | 7/1964 | Canada | 404/41 |
| 61662 | 5/1955 | France | 404/41 |

*Primary Examiner*—Stephen J. Novosad

*Attorney, Agent, or Firm*—Ralph B. Pastoriza

[57] ABSTRACT

Interconnecting members are provided for building up geodesic dome-like structures. In a first embodiment, there are provided strut members forming the edges of triangles utilized in the geodesic dome structure and gusset members provided at the vertices of the various formed triangles interconnecting with the ends of the strut members. The ends of the strut members and the gusset members are provided with cooperating integrally formed lip and recess portions arranged to be interlocked together, elastic resiliency of portions of the gusset member being provided to both enable the members to lie at an angle to each other and to be held in their interlocked relationship. In a second embodiment, the members making up the structural enclosure comprise triangular sheets of material, the side edges of the various triangular sheets having a series of projections and recessed generally of T-shaped configurations for interlocking with adjacent side edges of other triangular members, there again being provided resiliency in the T-shapes so that the members can lie at angles to each other and be held in their interlocked relationship by the resiliency involved while building up a geodesic dome structure.

5 Claims, 11 Drawing Figures

INTERCONNECTING MEMBERS FOR ENCLOSURES

This invention relates generally to interconnecting members for enclosures and more particularly, to the interconnection or joints themselves between members in forming structures such as geodesic dome-like structures.

BACKGROUND OF THE INVENTION

Geodesic structures, usually in the form of elongated rods forming sides of triangles and interconnected at their vertices to form large dome-shaped enclosures are well known in the art. The basic frame structure is normally covered with an appropriate skin if it is desired to provide a weather-tight enclosure for storage, camping tents, and other similar purposes. The geodesic structural aspects have the advantage of being very strong and yet made up of fairly lightweight material.

Normally some type of securement device is required at the intersection of vertices of the various triangles made up of the rod members. Bolts and nuts, straps, clamps, and similar securing devices have been used in the past. Normally, such fasteners are made of metal and require special tools for securing the same. Further, where bolt holes and the like are provided, fairly close tolerances must be maintained in the dimensioning of all of the component parts in order that proper registration will occur to enable proper fastening of the various vertices.

All of the foregoing characteristics of prior art geodesic dome-like structures make the assembly and disassembly of such structures a time-consuming operation. Moreover, because of the various different types of fastening means employed, not only are special tools often required, as mentioned heretofore, but the overall expense of manufacture and of the materials employed is greater than that which would result if fewer different types of component parts were employed and if there were a wider selection of materials available.

BRIEF DESCRIPTION OF THE PRESENT INVENTION

With the foregoing considerations in mind, the present invention contemplates the provision of interconnecting members particularly well-suited for use in assemblying geodesic type dome structures wherein the various problems associated with prior art structures are avoided.

More particularly, the present invention provides for interconnecting members in which no bolts or nuts, straps, clamps and similar types of securing means are required. A resulting advantage is that no special tools are necessary. Further, the interconnecting members may be formed from a wide selection of different types of materials and thus economically produced. Moreover, the number of different types of components parts can be greatly reduced because of this unique interlocking arrangement.

Briefly, and in a broadest aspect, the interlocking members include a first member having top and bottom surfaces with an integral lip formed at one end constituting an extension of the bottom surface, and a recess formed in the bottom surface at a given distance along the member from the lip. A second member, in turn, has top and bottom surfaces with an end portion for reception in the recess and a lip engaging portion spaced the same given distance from the end portion for receiving the lip of the first member. The arrangement is such that the first and second members can be interlocked together to form at least part of a structrual enclosure. At least one of the members has an elastic or resilient portion which is stressed during the interlocking operation so that when the members are released after being interlocked together, this resiliency will maintain them in interlocked relationship. The only characteristic required of the materials utilized is that they be resilient. In this respect, a preferred material is Finnish birch plywood which is readily available and fairly economical to use.

In a first embodiment of the invention, the first and second members comprise struts and gusset members, the struts forming the edges of triangles making up the geodesic structure and the gussets being utilized at the vertices of the triangles for interconnecting with the ends of the strut members.

In a second embodiment, the first and second members comprise similar triangular sheets having side edges formed with extensions and recesses of T-shape for interlocking with each other so that essentially an enclosure is provided for the resulting geodesic frame structure by the sheet members themselves, there being openings only at the vertices of the triangular sheets.

BRIEF DESCRIPTION OF THE DRAWINGS

A better understanding of this invention will be had by now referring to the accompanying drawings in which.

DETAILED DESCRIPTION OF THE INVENTION

Figure 1:
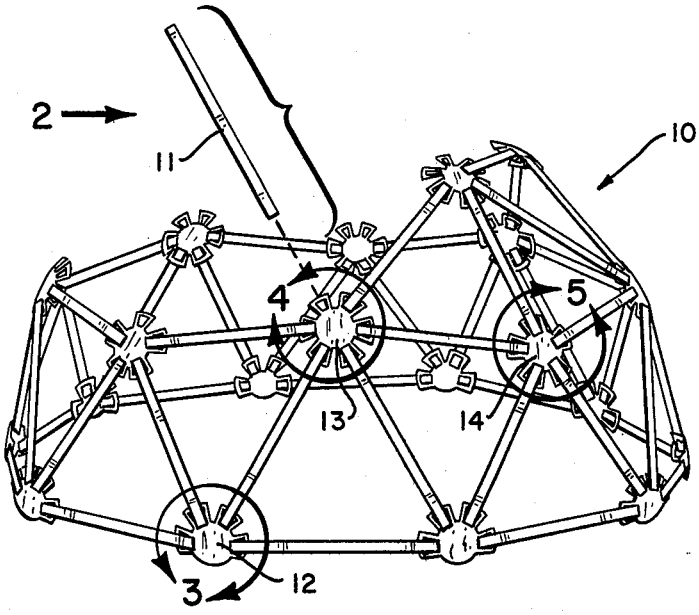
FIG. 1 is a perspective view of a partially constructed geodesic enclosure utilizing interconnecting members in accord with the first embodiment of the present invention.

Referring first to FIG. 1, there is shown a partially completed geodesic dome structure designated generally by the numeral 10. In this first embodiment of the invention, the structure is made up of first members in the form of struts, one of which is shown exploded away from the structure at 11. Second members of the structure take the form of gussets serving to interconnect the vertices of triangular figures formed by the struts 11. One such gusset member is indicated at 12 arranged to interconnect four of the strut members. A second type of gusset member is indicated at 13 designed to interconnect six strut ends, and, a third gusset type member is shown at 14 designed to interconnect five strut ends.

It will be understood in the embodiment of FIG. 1 that a structure has been chosen illustrative of the different types of members that can be provided in accord with the present invention. Actually, there are certain geodesic domes wherein the struts 11 could all be of identical length and construction and the interconnecting gusset members all of identical construction except for those around the base portion.

Figure 2:
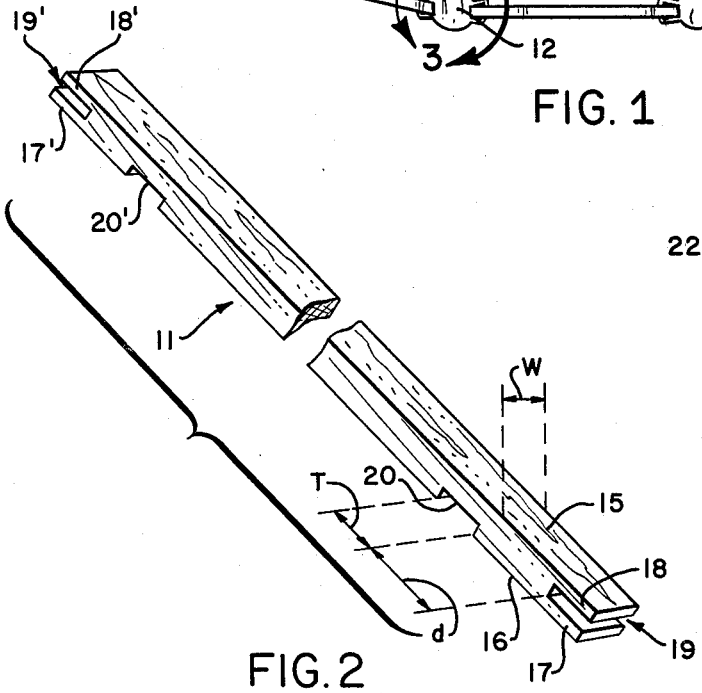
FIG. 2 is an enlarged perspective view of a first type of member utilized in the construction of FIG. 1.

Referring now to FIG. 2, there is shown the first member in the form of the strut 11 in enlarged view. Essentially the member 11 has top and bottom surfaces 15 and 16 and includes a lip 17 constituting an extension of the bottom surface 16 at one end. In the embodiment illustrated, the top surface 15 is also extended forwardly to define an upper side wall 18 which, cooperating with the lip 17, defines an end slot 19.

The bottom surface 16 of the strut of FIG. 2 also is formed with a recess 20 in the form of a transverse channel in the embodiment shown. This recess 20 is spaced a given distance d from the lip 17.

The opposite end of the strut 11 is provided with lip 17', upper side wall 18' to define an end slot 19', and a recess 20'. These latter mentioned slot and recess structures are dimensioned identically to the slot 19 and recess 20 in the first end portion of the strut 11.

Figure 3:
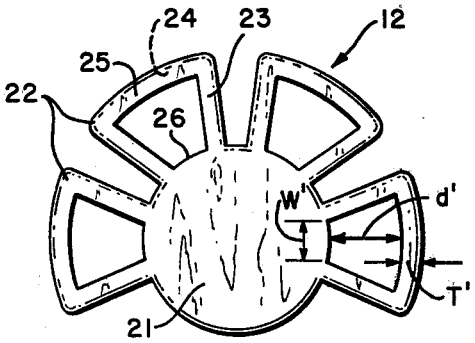
FIG. 3 is a plan view of a second member enclosed within the circular arrow 3 of FIG. 1.

Referring now to FIG. 3, there is illustrated the gusset 12 constituting one of the various gussets forming the second members of the structure described in FIG. 1. As shown, this gusset member includes a central hub 21 having a plurality of radially extending end portions 22. Each of these end portions is identical and therefore a detailed description of one will suffice for all. Thus, each of the end portions has top and bottom surfaces 23 and 24 and an end 25 for reception in the recess of one of the strut members as will become clearer as the description proceeds. Also, a peripheral portion of the hub 21 defines a lip engaging portion 26 spaced from the recess receiving portion 25 by a given distance d', shown for the right hand extending end portion in FIG. 3. The distance d' is the same as the distance d in FIG. 2 between the lip and recess portion. Also, it will be noted that the peripheral hub portion 26 has a dimension w' as designated on the right end portion of FIG. 3 while the end 25 is indicated as having a width T'. The dimensions w' and T' correspond respectively to the width w of the strut 11 shown in FIG. 2 and the distance T between the ends of the recess 20; that is, the distance across the channel defining the recess.

Actually, for dimensions d', w' and T' of FIG. 3, d' and w' are slightly more and T' slightly less than the corresponding d, w and T of FIG. 2 so that the structures can be interlocked as will become clearer as the description proceeds without requiring close tolerances. Where these dimensions are described as corresponding or the same, it will be understood that sufficient difference exists to enable proper intercoupling together.

Since the gusset 12 of FIG. 3 is used along the base perimeter of the enclosure structure of FIG. 1, it only requires four radially depending end portions 22.

Figure 4:
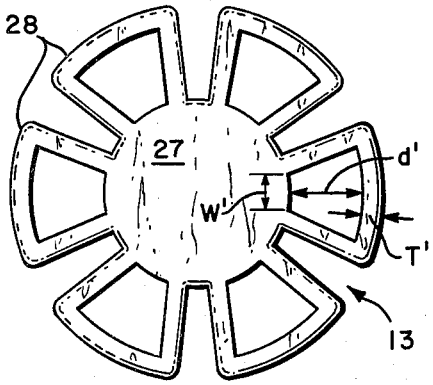
FIG. 4 is a plan view of another structural member enclosed within the circular arrow 4 of FIG. 1.

In FIG. 4, there is shown the gusset 13 of FIG. 1 wherein again there is provided a central hub 27 with radially extending end portions 28. For the particular position of this gusset, there are provided six radially extending end portions as shown.

Figure 5:
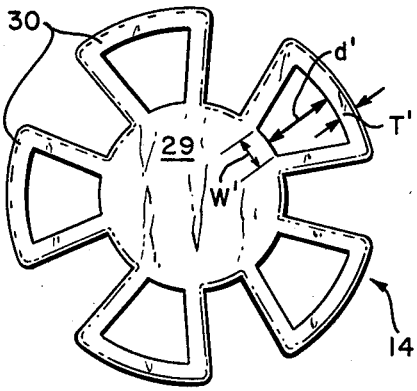
FIG. 5 is a plan view of yet another structural member enclosed within the circular arrow 5 of FIG. 1.

Finally, the gusset 14 shown in FIG. 5 comprises a central hub 29 with five radially extending end portions 30 and it is used alternately with the gussets of FIG. 4 travelling in circumferential directions about the structure of FIG. 1.

In all of the gussets, the dimensions d', w' and T' are identical.

Figure 6:
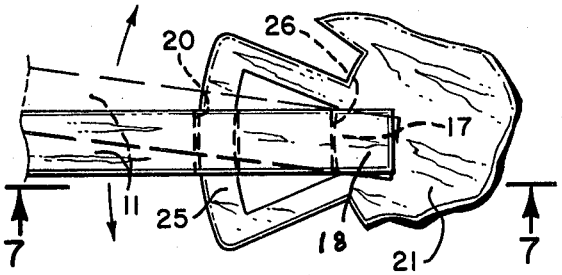
FIG. 6 is a fragmentary plan view illustrating the manner of interconnection of first and second members in accord with the construction of FIG. 1.

Referring now to the fragmentary plan view of FIG. 6 there is shown the strut member 11 with one end interlocked with one of the end portions of a gusset member such as the gusset member shown in FIG. 3. Thus, the lip 17 forming part of the slot for the strut 11 engages under the peripheral portion of the hub 21 indicated at 26, the top wall 18 overlying this peripheral portion.

The outer end 25 of the extending end portion of the gusset, in turn, is received in the channel recess 20 of the strut 11.

It will be noted in FIG. 6 that the end 25 is of greater length than the peripheral hub portion 26 thereby permitting some lateral swinging of the interlocked strut 11 such as indicated by the phantom lines. This small amount of lateral swing facilitates assembly of the entire enclosing structure as shown in FIG. 1 compensating for the actual though minor resulting side to side angular differences of the struts in their final configuration in various geodesic forms.

Figure 7:
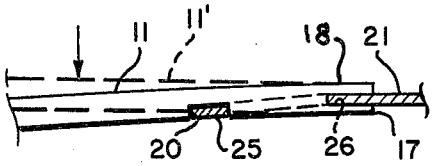
FIG. 7 is a fragmentary cross section taken in the direction of the arrows 7—7 of FIG. 6.

FIG. 7 shows in side view and cross section the interlocking arrangement described in FIG. 6. It will be noted that the extending end portion of the gusset can flex downwardly as viewed in FIG. 7 so that the plane of the strut 11 forms an angle to the plane of the hub 21 of the gusset. This angulation permits formation of an essential dome shape when forming the enclosure. It is possible to provide the overall "curved" appearance as a consequence of this flexibility. Moreover, and more importantly, the flexible nature of the extending end portions of the gusset permit the interlocking of the strut with the gusset to be readily achieved, the extreme end 25 being deformed downwardly as the slot is slid onto the hub portion. The end 25 then snaps up into the channel 20 of the strut 11, the resilient character of the extending end portion of the gusset retaining the members in interlocked relationship.

It can be appreciated from all of the foregoing that the geodesic frame structure of FIG. 1 can be completely built up by simply utilizing strut and gusset members as described. Further, since the interlocking arrangements are integral with the members, no auxiliary parts such as nuts, bolts, straps, clamps and the like are necessary. Moreover, the members can be readily assembled manually without any tools.

Figure 8:
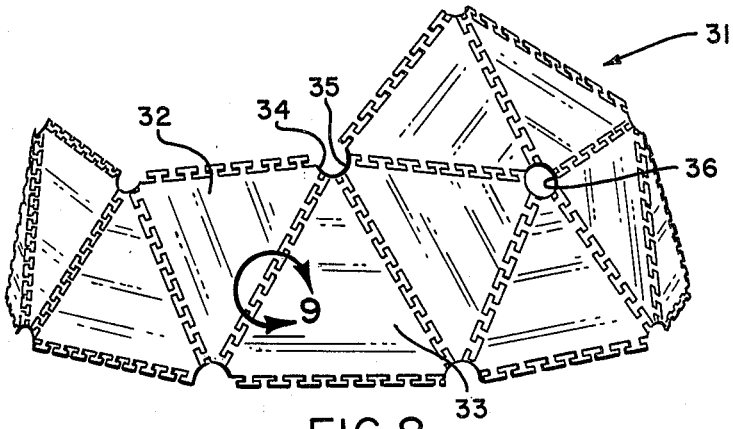
FIG. 8 is a perspective view of a partially constructed geodesic structure utilizing members in accord with a second embodiment of the present invention.

Referring now to FIG. 8, there is illustrated a second embodiment of the invention wherein the first and second members are in the form of triangular sheets such as indicated at 32 and 33. The vertices of these triangular sheets are truncated such as indicated at 34 and 35 respectively. As a consequence, when the various triangular sheets are interlocked together along their side edges as shown in FIG. 8, there will be left openings such as indicated at 36 at the various vertices.

The interlocking of the first and second members 32 and 33 in the embodiment of FIG. 8 is essentially the same in principle as that described for the strut and gusset members in the first embodiment.

Figure 9:
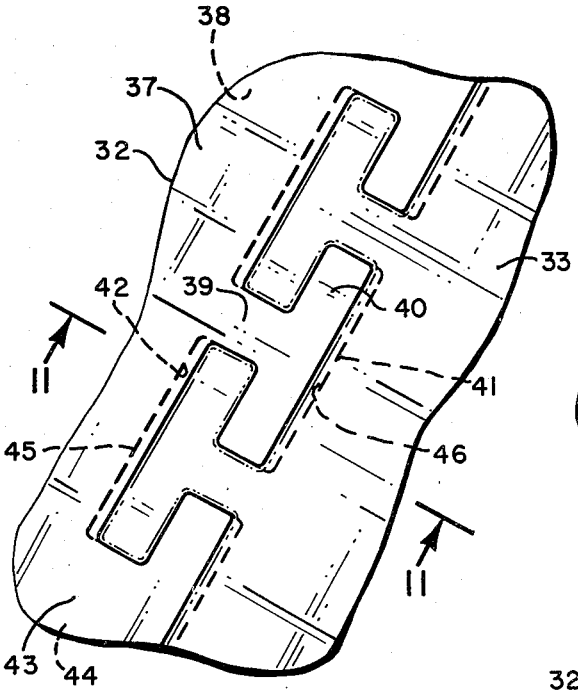
FIG. 9 is a greatly enlarged plan view of a portion of the structure enclosed within the circular arrow 9 of FIG. 8.

More particularly, and with reference to FIG. 9 it will be noted that the first member 32 has top and bottom surfaces 37 and 38 and includes a projecting side portion made up of a stem 39 and cross portion 40 defining a T-shape. The outer lower surface of the cross portion 40 extends outwardly to define a lip 41. A recess 42, in turn, is formed on either side of the stem portion 39 spaced inwardly of the lip 41 by a given distance D.

Figure 10:
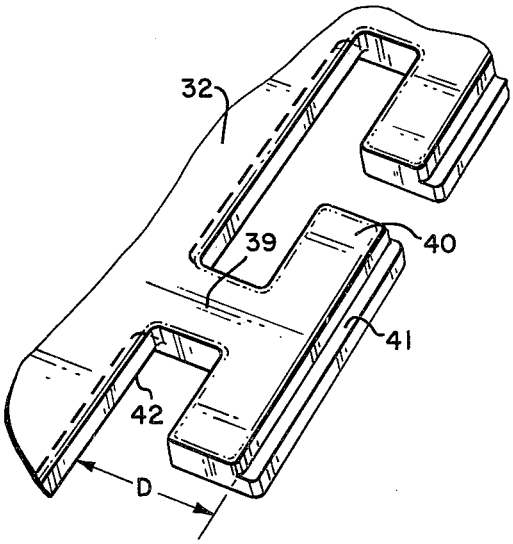
FIG. 10 is an enlarged fragmentary perspective view of a portion of one of the members shown in FIG. 9 separated from the other member; and, FIG. 11 is a fragmentary cross section taken in the direction of the arrows 11—11 of FIG. 9.

The foregoing arrangement can better be seen by referring to FIG. 10 which shows the first member 32 by itself and wherein the dimension D is clearly set forth.

Referring back to FIG. 9, the second member 33 has a complimentary T-shaped projecting side dimensioned to interlock with the first T-shape made up of the stems 39 and 40. In this respect, the complimentary T-shape has a lip portion designated 45 and a recessed portion designated 46. As can be seen by the phantom lines in FIG. 9, the lip 41 of the first member is received in the recessed portion 46 of the second member and the lip 45 of the second member is received in the recess 42 of the first member. Actually, the triangular edge portions of the first and second members 32 and 33 are precisely the same so that when one is turned around into opposing relation, it interfits neatly with the other.

Figure 11:
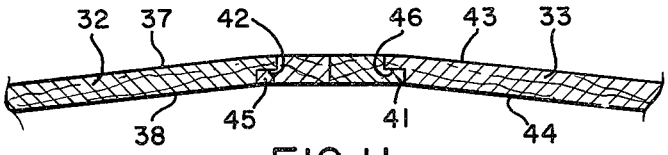

The foregoing can be better seen with reference to FIG. 11 which shows the interconnecting portions in cross section. The material making up the triangular sheets 32 and 33 is relatively thin. Bending to permit the planes of the adjacent triangular members to form a slight angle as shown in FIG. 11 when forming a geodesic configuration takes place at the stem portions. Such bending can thus be achieved without distress or "binding" as a consequence of the geodesic configuration.

The cut-out vertices of the various triangular shapes as described in conjunction with FIG. 8 permit intercoupling of the adjacent sides in the manner illustrated in FIGS. 9 and 11 without any "binding" occurring at the vertices; that is, without interference between projecting portions at the vertices. The openings or holes such as indicated at 36 remaining when the dome structure has been completed, can serve as ventilation openings, or windows or if desired, can in turn be covered up with appropriate coverings of any suitable design.

As in the case of the gusset member described in FIGS. 6 and 7, the interconnecting T-shaped structures of FIGS. 9 and 10 are resilient so that once the interlocking has been achieved, this resiliency will tend to hold the members in interlocked relationship particularly when they are biased into a curved shape such as illustrated in FIG. 11. The interlocking principle and its similarity to that shown in FIGS. 6 and 7 is evident in that in each instance there is provided a lip and a recess spaced an appropriate distance from each other which are inter-engaged with similar lips and recesses in the second member or equivalent areas thereto.

Further, and as also indicated in the embodiments of FIGS. 6 and 7, the triangular shapes can be assembled without the use of particular tools, the interlocking means again constituting integrally formed portions of the members themselves.

From all of the foregoing, it can be seen that each of applicant's embodiments provides a greatly improved means for forming geodesic structures wherein disadvantages of prior art systems are avoided. As already mentioned, no special fastening such as nuts and bolts are required, no special tools are required, and once the members have been interconnected, they are essentially self-locking in place as a consequence of the resiliency inherently provided by the material used.

In further respect of the foregoing, there is a wide choice of materials, the only requirement being that the same be flexible as described heretofore.

Actual embodiments of the present invention have been formed from plywood. However, flexible plastic and metal members might be used.

The number of different shaped members actually used can be minimized by selecting certain types of geodesic enclosures. For example, there are certain geometries where all of the strut members could be of identical length and all of the gussets of the same type except those along the base line as mentioned heretofore.

In the case of the triangular shaped surfaces, both the counterparts to the first and second members mentioned in the first embodiment can be identically constructed; that is, all of the triangles can be the same, the structures neatly interfitting when their sides are placed in closing relationship. Again, there are only certain geodesic structures which can accommodate triangles of all identical size. However, there are other shaped curved enclosures which can be made up utilizing the principles of the present invention wherein certain of the triangles are of different size.

From all of the foregoing, it will thus be evident that the present invention has provided improved interconnecting members for enclosures particularly useful in the construction of geodesic domes.

It will be understood that in the first embodiment, the triangular frame work formed by the struts can be covered with any suitable material to form the enclosure. In the second embodiment, the triangularly shaped "sheets" form the enclosure but may be covered with additional material if desired to close off the openings at the vertices.

As mentioned, the simplest (lower frequency breakdowns) geodesic domes can be formed with all strut members of the same length in the first embodiment. Conversely, there are certain geodesic domes (higher frequency; elliptical, octahedral or tetrahedral) where there is a greater variety of strut lengths and gusset types. The specific embodiment of FIG. 1 requires only two different strut lengths and the three types of gusset members shown.

I claim:

1. Interconnecting members for enclosures including, in combination:

(a) a first member having top and bottom surfaces with a lip formed at one end constituting an extension of the bottom surface, and a recess formed in said bottom surface at a given distance along said member from said lip; and (b) a second member having top and bottom surfaces with an end portion for reception in said recess and a lip portion, whereby said first and second members can be interlocked together to form at least part of a structural enclosure, said first member constituting an elongated strut with its said recess in the form of a transverse channel of given width cut in its bottom surface, the opposite end of said first member similarly having a lip and recess of the same dimensions as said first mentioned lip and recess, said second member comprising a gusset having a central hub, said lip engaging portion constituting a peripheral part of said hub and said end portion spaced from said hub, and at least one additional other peripheral hub portion and end portion extending from said additional peripheral hub portion and having the same dimensions as said first-mentioned peripheral hub portion and end portion so that at least one additional strut member can be interlocked with said gusset in the formation of said structural enclosure.

2. The subject matter of claim 1, in which said lip constitutes the lower side wall of an end slot in said strut, the end portions from the hub being flexible so that the struts can lie in planes at angles to the plane of the central hub, the resiliency of the end portions holding them in interlocking engagement with the struts.

3. The subject matter of claim 2, in which said end portion in each of the extending end portions is wider than the peripheral hub portion from which the end portion extends to that slight lateral movement of an interlocked strut is possible to avoid undue binding and avoid close tolerances when forming said structural enclosure.

4. Interconnecting members for enclosures including, in combination:

(a) a first member having top and bottom surfaces with a lip formed at one end constituting an extension of the bottom surface, and a recess formed in said bottom surface at a given distance along said member from said lip; and (b) a second member having top and bottom surfaces with an end portion for reception in said recess and a lip portion, whereby said first and second members can be interlocked together to form at least part of a structural enclosure said first member comprising a triangularly shaped sheet, said one end constituting at least one projecting side edge made up of a stem and cross portion defining a T-shape, the outer lower surface of the cross portion extending outwardly to define said lip, said recess being formed on either side of said stem portion spaced inwardly of said lip by said given distance, said second member being of triangular shape with a complimentary T-shape projecting side edge dimensioned to interlock with said first mentioned T-shape.

5. The subject matter of claim 4, in which there are provided a plurality of T-shapes along all side edges of the triangles making up the first and second members, the side edges terminating short of the vertices of the triangular shapes and the vertices themselves being truncated, the T-shapes all being flexible at their stem portions so that interlocked members can lie in planes at an angle to each other to permit building up said structural enclosure, the resiliency of the T-shaped members holding the members in interlocked relationship.

* * * * *